United States Patent [19]

Menkel, Jr. et al.

[11] 3,946,885

[45] Mar. 30, 1976

[54] CAB FOR WASTE COLLECTION VEHICLE

[75] Inventors: John P. Menkel, Jr.; Stewart N. Metz, both of Tulsa, Okla.

[73] Assignee: Crane Carrier Company, Tulsa, Okla.

[22] Filed: July 8, 1974

[21] Appl. No.: 486,469

[52] U.S. Cl. ..... 214/302; 296/28 CV; 296/146

[51] Int. Cl.[2] ..... B65F 3/02

[58] Field of Search..... 214/302, 303, 146.5, 146 R, 214/146 G, 146 AS, 146 T, 75 H, 77 R; 296/146, 28 C, 28 CV

[56] References Cited

UNITED STATES PATENTS

| | | | |
|---|---|---|---|
| 2,240,586 | 5/1941 | Thompson | 296/146 |
| 2,256,890 | 9/1941 | Brown et al. | 296/28 C |
| 2,529,200 | 11/1950 | Swanson | 296/146 |
| 2,984,374 | 5/1961 | Herpich et al. | 214/302 |
| 3,802,530 | 4/1974 | Purcell et al. | 296/146 |
| 3,841,430 | 10/1974 | Babbitt, Jr. et al. | 296/28 C |

*Primary Examiner*—Robert J. Spar
*Assistant Examiner*—Lawrence J. Oresky
*Attorney, Agent, or Firm*—Head & Johnson

[57] ABSTRACT

A driver operator cab for waste collection vehicles includes a visual inspection port to permit alignment of lift forks relative to the trash container without aid from other persons and without leaving the normal position of the driver of the vehicle.

4 Claims, 6 Drawing Figures

CAB FOR WASTE COLLECTION VEHICLE

BACKGROUND OF THE INVENTION

A type of solid waste collection system includes what is known as a "front loader" type, which is a vehicle including a forward cab and a rearward collection hopper. The latter may include a compaction system in order to provide greater pay loads to the vehicle. In use the driver operator would lower hydraulically operated lifting forks or other means, drive forward relative to a trash container and engage the lifting means or forks therewith. Subsequently the container is lifted over the vehicle back to the collection hopper where it is dumped. The container is then returned to its position, the truck reversed to disengage the lifting forks which are then retracted. The vehicle is then driven to the next trash container where the cycle is repeated.

One difficulty has been that because of the relationship of the dashboard within the truck cab a single driver operator was required to leave his normal seated position within the cab and in some instances stand up in order to align the --lifting tongs with the container. In addition, there has been a need for the driver of the vehicle to have a substantially clear vision in the direction to his right side to ascertain whether there are other vehicles in the right hand lane of the street or road. Furthermore, since the vehicle stands up so high, it is sometimes difficult for the driver to see a small foreign or sports type car which may drive up on the right hand side of the vehicle, or on the driver's right hand side.

SUMMARY OF THE INVENTION

The present invention contemplates a novel waste collection vehicle particularly designed and constructed for overcoming the goregoing disadvantages. The vehicle cab is provided with a windshield which extends fairly low with relation to the usual windshield of the normal vehicle of this type, and includes auxiliary small ports or openings disposed on opposite sides of the cab whereby the driver of the vehicle has further access of visibility to the lifting tongs. The dashboard of the vehicle is also cut away, leaving an opening coinciding with the new visibility openings on the driver's side of the cab. An incidental benefit of this cut away portion in the dashboard is that it alleviates the disadvantage of the accidental engagement of the driver's knees with the dashboard during operation of the vehicle clutch pedal. In order to substantially eliminate the problem of the smaller cars approaching on the right hand side of the driver, an additional viewing port is provided in the right hand door of the cab. Of course, it is preferable that all of the visual improving ports be sealed and filled with transparent glass, or the like, material.

DETAILED DESCRIPTION

Before explaining the present invention in detail, it is to be understood that the invention is not limited in its application to the details of construction and arrangement of parts illustrated in the accompanying drawings, since the invention is capable of other embodiments and of being practiced or carried out in various ways. Also, it is to be understood that the phraseology or terminology employed herein is for the purpose of description and not of limitation.

Figure 1:
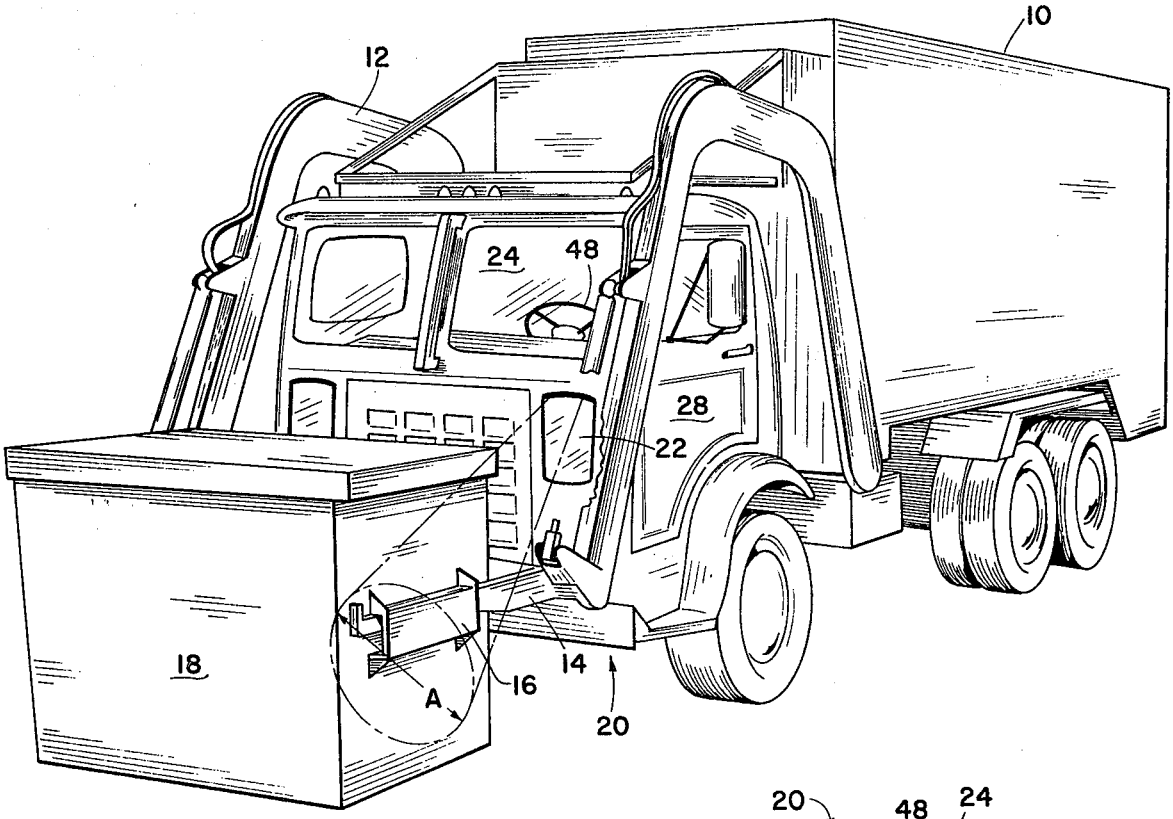
FIG. 1 is a perspective view of a waste collection vehicle embodying the invention.
Figure 2:
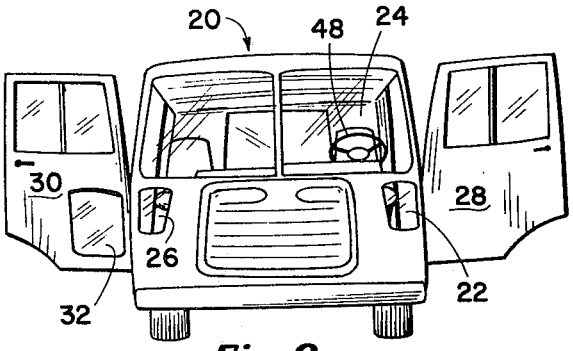
FIG. 2 is a front view of a waste collection vehicle embodying the invention and depicing the cab doors in an open position.
Figure 3:
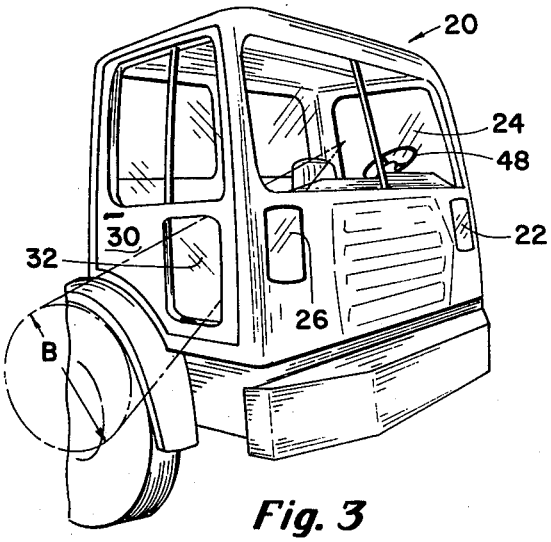
FIG. 3 is a perspective view from the front righthand side of the vehicle.
Figure 4:
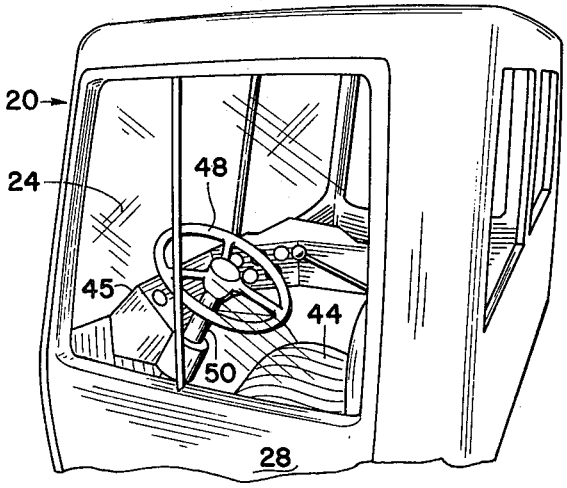
FIG. 4 is a partial view of the driver operator side of the cab of this invention.

Referring now to FIG. 1 an overall view of the apparatus to which this invention applies is shown including a wheeled vehicle of the front loader type for solid waste collection systems. That which is known in the prior art includes the collection hopper portion 10, the fork lift apparatus 12 which includes in this embodiment spaced apart forks 14 of which the left side is shown in view, there being a duplicate on the other side, not shown. These forks 14 are adapted to engage with lift housing 16 to raise a trash container 18 up over the cab of the vehicle and dump same into the collection hopper.

This invention relates to the cab generally designated by the numeral 20, the basic improvement of which includes the provision of a glassed in port 22 in the forwardmost portion of the cab and which is positioned below the normal front windshield of the vehicle 24. A similar port 26 may be provided on the other side in a like position although this is not absolutely necessary. In addition, the cab has the usual left and right sides which may include doors 28 and 30 with the right side door also including a visual port 32 which provides visual access from the driver's position to vehicles which may be in a righthand lane and which vehicles yet are not high enough to be normally seen through the upper window of the righthand door, as for example, smaller sportscars and the like. Because of the port 22 a cone of vision "A" is provided to the driver as shown in FIG. 1. This cone of vision permits the driver to align the fork 14 with the means 16 of the trash container 18 from his normal seated position.

Figure 5:
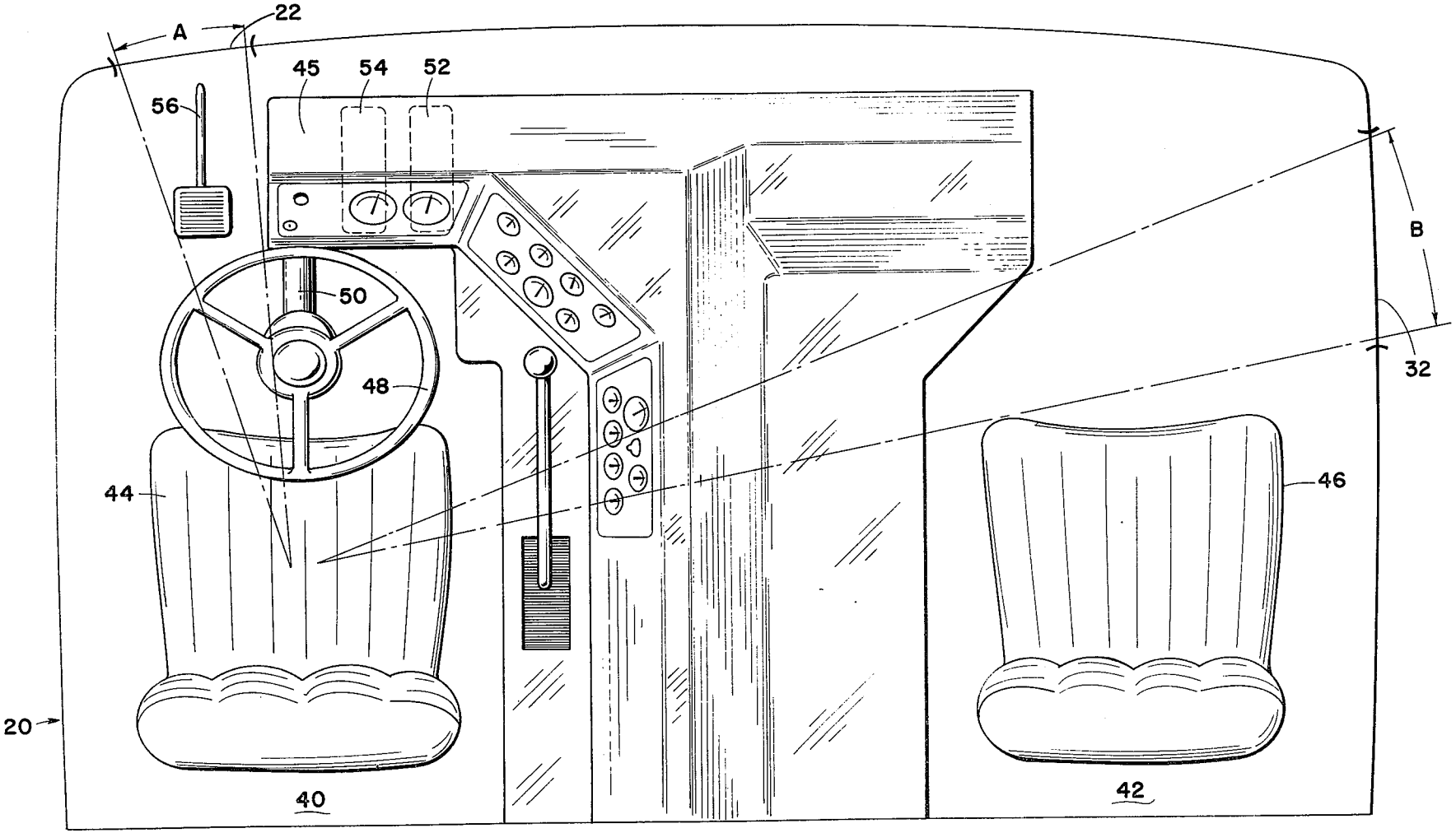
FIG. 5 is a top plan view of the interior of the driver operator cab.

Referring now to FIG. 5 the cab 20 includes a driver's compartment defined by a floorboard 40 and in some instances a co-driver's compartment 42 on the other side of the vehicle. The driver-operator normally is in a seat 44 while a seat 46 may be provided for the co-driver. Heretofore this invention, the driver operator's forward vision was limited downwardly by a dashboard which extended normally across the front of the vehicle or at least in front of the driver operator. In this invention the instrument panel begins at a point slightly left of the middle of the steering wheel 48 post or column 50, with the instruments, as necessary in the operation of the vehicle, being placed there and to the right on a dashboard display of the driver operator. This, in combination with the port 22 provides the cone of vision "A" to the driver operator from his position to the forward end of the lift fork 14. The accelerator pedal and brake pedal, respectively 52 and 54, are shown in dotted line in their normal position. The clutch 56 is positioned to the left of the dashboard 45. Thusly, as an unseen benefit of the invention there is provided a complete opening above the knee of the operator whereby in the up and down operation of the clutch pedal 56 there is no engagement with the underside of a dashboard normally found in vehicles of the prior art.

By the provision of the right side port 32 in the door 30 of the vehicle a second cone of vision "B" is provided the driver operator and is of secondary importance to the design and operator of the vehicle. This port provides knowledge of vehicles of a smaller size, e.g. sports vehicles and the like which normally cannot be seen by the driver through the usual door windows.

Thus, the invention herein described provides a means whereby a single driver operator is capable of operating a front loader type of waste disposal collection vehicle without the need for other parties or apparatus to provide alignment of the vehicle with the trash container to which it is adapted.

Figure 6:
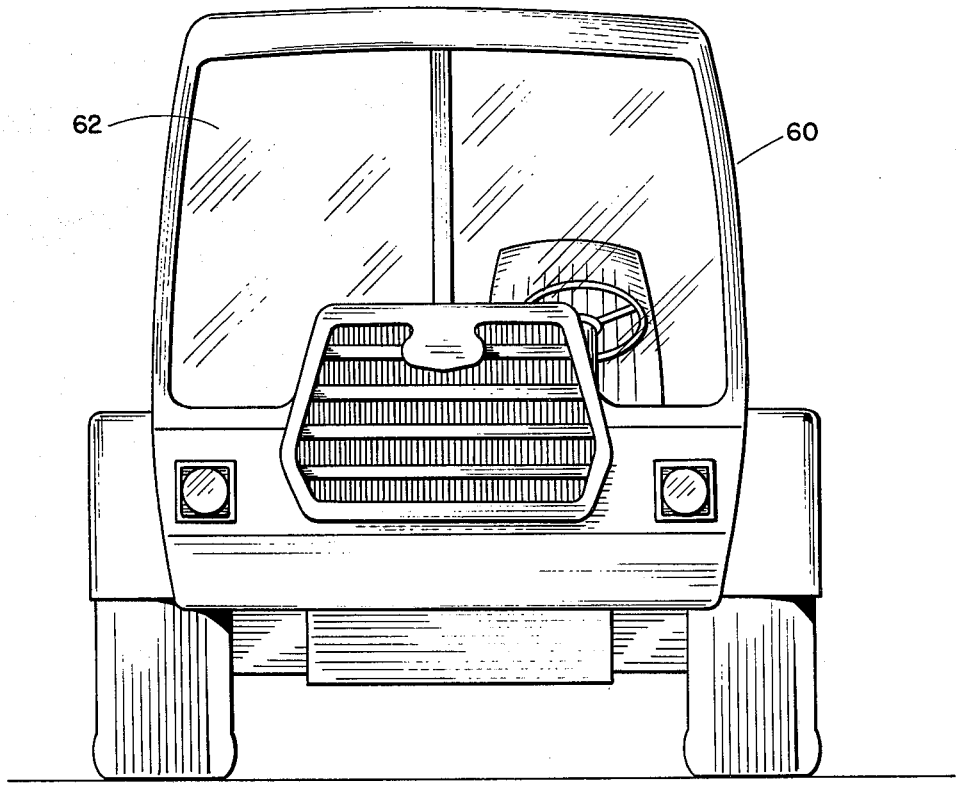
FIG. 6 is a front plan view of a modified form of the invention.

One modification is described in FIG. 6 wherein the left and right windshield 60 and 62 are constructed of a single sheet to include an L-shape as shown and thus provde the visual inspection port as taught herein.

Although the invention has been described with reference to front loading and wast collection type vehicles it is understood that the concepts herein are applicable to other types of vehicles where front end vision needs are demanded.

What is claimed:

1. In a vehicle carrier having:

a forward drive-operated enclosed cab, said calb having sides, a steering column, dashboard, floorboard, seat for said driver operator therebehind and forward windshield, a carrier portion disposed rearwardly of said cab, and means to pick up goods immediately forward of said cab and deliver said goods over said cab and rearwardly to said carrier portion, the improvement in said cab comprising:

a transparent port at the forwardmost portion of said cab on the driver operator's side and positioned in the area defined above said floorboard and below said windshield, and between said steering column and said side of said vehicle and said dashboard extends from about an imaginary vertical plane of said steering column toward the center of said cab, whereby a cone of vision to said means to pick up said goods is provided said driver operator from his normal seated position downwardly and forwardly of said cab with the lateral sides of the cone of vision at said port being bordered by the operator driver's side of the cab and the operator driver's end side of the dashboard.

2. The carrier of claim 1 wherein said cab includes a second port in said defined area on the other side of said cab.

3. In a vehicle carrier having:

a forward driver-operated enclosed cab, said cab having sides, a steering column, dashboard, floorboard, seat for said driver operator therebehind and forward windshield, a carrier portion disposed rearwardly of said cab, and means to pick up goods immediately forward of said cab and deliver said goods over said cab and rearwardly to said carrier portion, the improvement in said cab comprising:

a transparent area at the forwardmost portion of said cab on the driver operator's side and positioned in the area defined above said floorboard and below the upper limit of the dashboard, and between said steering column and said side of said vehicle, and said dashboard extends from about an imaginary vertical plane of said steering column toward the center of said cab, whereby a cone of vision to said means to pick up said goods is provided said driver operator from his normal seated position when said means to pick up said goods is engaging the goods immediately forwardly of said cab, with the lateral sides of the cone of vision at said area being bordered by the operator driver's side of the cab and the operator driver's end side of the dashboard.

4. The carrier of claim 3 wherein said windshield and said transparent area are formed of a unitary piece of glass.

* * * * *